US005136170A

United States Patent [19]

Gellert

[11] Patent Number: 5,136,170

[45] Date of Patent: Aug. 4, 1992

[54] IRRADIATION DEVICE

[75] Inventor: Bernd Gellert, Wettingen, Switzerland

[73] Assignee: Asea Brown Boveri Ltd., Baden, Switzerland

[21] Appl. No.: 677,340

[22] Filed: Mar. 29, 1991

[30] Foreign Application Priority Data

Mar. 30, 1990 [DE] Fed. Rep. of Germany ..... 4010190

[51] Int. Cl.[5] ..... H05B 41/16

[52] U.S. Cl. ..... 250/492.1; 250/504 R; 315/248

[58] Field of Search ..... 250/492.1, 504 R, 461.1; 315/248; 313/622, 635, 234

[56] References Cited

U.S. PATENT DOCUMENTS

| | | | |
|---|---|---|---|
| 4,266,162 | 5/1981 | McNeill et al. | 315/248 |
| 4,266,167 | 5/1981 | Proud et al. | 315/248 |
| 4,647,821 | 3/1987 | Lapatovich et al. | 315/248 |
| 4,675,577 | 6/1987 | Hanlet | 315/248 |
| 5,013,959 | 5/1991 | Kogelschatz | 315/248 |

OTHER PUBLICATIONS

Applied Physics B 46, (1988), B. Eliasson et al., "UV Excimer Radiation from Dielectric-Barrier Discharges", pp. 299-303.

*Primary Examiner*—Jack I. Berman
*Assistant Examiner*—Kiet T. Nguyen
*Attorney, Agent, or Firm*—Oblon, Spivak, McClelland, Maier & Neustadt

[57] ABSTRACT

The irradiation device for drying and/or curing paints, varnishes and similar coatings (13, 14) has at least one UV high-power radiator having a discharge space (3) filled with filling gas. The filling gas contained therein emits radiation under the effect of silent electrical discharges. The discharge space (3) is bounded by walls (1, 2), at least one wall consisting of dielectric material and being transmissive to the radiation generated in the discharge space (3). A pair of electrodes (4, 5), with an AC source (10) connected to the two electrodes, serves for feeding the discharge. The treatment space (6) is immediately adjacent to the dielectric (1, 2). The electrodes (4, 5) are positioned at a distance from the immediately neighboring dielectric. The coupling of the electrical energy from the electrodes into the discharge space takes place essentially capacitively. In this way, as well as the discharges in the actual discharge space (3), which are responsible for the generation of UV or VUV radiation, there also occur in the treatment spaces (6, 7) electrical discharges which, along with the radiation produced in the discharge space (3), additionally act catalytically on said coatings and substantially accelerate the drying/curing of the coating (13, 14).

9 Claims, 2 Drawing Sheets

IRRADIATION DEVICE

BACKGROUND OF THE INVENTION

1. Field of the Invention

The invention relates to an irradiation device for drying and/or curing paints, varnishes and similar coatings. It concerns in particular such a device having at least one UV high-power radiator, preferably an excimer radiator, having a discharge space filled with filling gas, the filling gas emitting radiation, preferably excimer radiation, under the effect of silent electrical discharges, the discharge spaced being bounded by walls, of which at least one wall consists of dielectric material and is transmissive to the radiation generated in the discharge space, having a pair of electrodes, a treatment spaced immediately adjacent to one of the walls of the discharge space, and having an AC source connected to the two electrodes for feeding the discharge.

The invention at the same times makes reference to European Patent Application 87109674.9 of Jul. 6, 1987 with the publication number 0,254,111 or to Swiss Patent Application 152/88-7 of Jan. 15, 1988 of the applicant.

DISCUSSION OF BACKGROUND

UV and VUV high-power radiators of the type mentioned at the beginning were presented to the public for the first time in the paper by U. Kogelschatz "Neue UV- and VUV-Excimerstrahler" (New UV and VUV Excimer Radiators), read before the 10th Conference of the Gesellschaft Deutscher Chemiker Fachgruppe Photochemie (German Chemists' Society, Photochemistry Study Group), Würzburg, Nov. 18–20, 1987. A more detailed description of this new type of radiator is to be found in the Article by B. Eliasson and U. Kogelschatz "UV Excimer Radiation from Dielectric-Barrier Discharges" in the Journal Appl. Phys., Vol. 46, 299–303 (1988).

This high-power radiator can be operated with great electrical power densities and high efficiency. Its geometry can be adapted within broad limits to the process in which it is used. Thus, apart from large-area, flat radiators, cylindrical radiators, which radiate inwardly or outwardly, are also possible. The discharges can be operated at high pressure (0.1–10 bar). With this design, electrical power densities of 1–50 $KW/m^2$ can be realized. Since the electron energy in the discharge can be substantially optimized, the efficiency of such radiators is very high, even if resonance lines of suitable atoms are excited. The wavelength of the radiation can be set by the type of filling gas, for example mercury (185 nm, 254 nm), nitrogen (337 nm–415 nm), selenium (196 nm, 204 nm, 206 nm), arsenic (189 nm, 193 nm), iodine (183 nm), xenon (119 nm, 130 nm, 147 nm), crypton (124 nm). As in the case of other gas discharges, the mixing of different types of gas is also recommendable.

Apart from these lines radiators, which radiate spectral lines, radiators with gases or gas mixtures in which excimer radiation is produced are also particularly of interest. Examples which may be mentioned are the rare gases and rare gas/halogen mixtures.

The advantage of these radiators lies in the areal radiation of great radiated powers with high efficiency. Virtually the entire radiation is concentrated on a single or a few ranges of wavelengths.

A significant field of application for these UV high-power radiators is the drying and/or curing of varnishes, paints and similar coatings which contain photoinitiators on substrates of paper or plastic in strip or sheet form or on other, rather more complicatedly shaped workpieces such as pieces of furniture etc.

In the case of such drying or curing installations, the substrates or workpieces are taken past large-area UV radiators at a defined distance from them in a type of treatment chamber.

Because the period of exposure to the UV radiation has a decisive influence on the productivity of these installations, there is a great demand for powerful radiators with short exposure times.

SUMMARY OF THE INVENTION

Accordingly, one object of this invention is to provide a novel irradiation device having a UV or VUV radiator which permits very short exposure times and, in addition, permits a simple and cost-effective design.

This object is achieved according to the invention by the one electrode being positioned at a distance from the dielectric immediately neighboring it in such a way that the coupling of the electrical energy from this one electrode into the discharge space takes place essentially capacitively, so that, as well as the discharges in the actual discharge space, which are responsible for the generation of UV or VUV radiation, there also occur in the outside space electrical discharges which, along with the radiation produced in the discharge space, additionally act catalytically on said coatings.

It has been found in particular in the case of drying and curing paints and varnishes that, in a treatment space filled with normal ambient air, the reaction products of the "outside discharges" developing in fact in this space — mainly ozone and nitrogen oxides — have an unpredictable accelerating effect on the drying or curing process of the coating. Essentially the only precondition for this is that the reaction products of the "outside discharges" absorb the UV radiation only insignificantly or not at all. Another finding, likewise rather surprising, is that the radiator could be operated at comparatively lower frequencies of the feed voltage $\leqq 20-30$ kHz) and less (UV radiation) power, less by less than an order of magnitude, had to be expended. On the other hand, in the case of typical radiator geometries, the required AC voltages tended to have to be higher ($\geqq 3$ kvolts) in order to be certain to generate "outside discharges" and to generate sufficient reaction products.

The advantage of the invention is to be seen in particular in that the radiation generated in the discharge space can be utilized virtually completely and that compact irradiation devices from which no UV radiation escapes can be constructed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
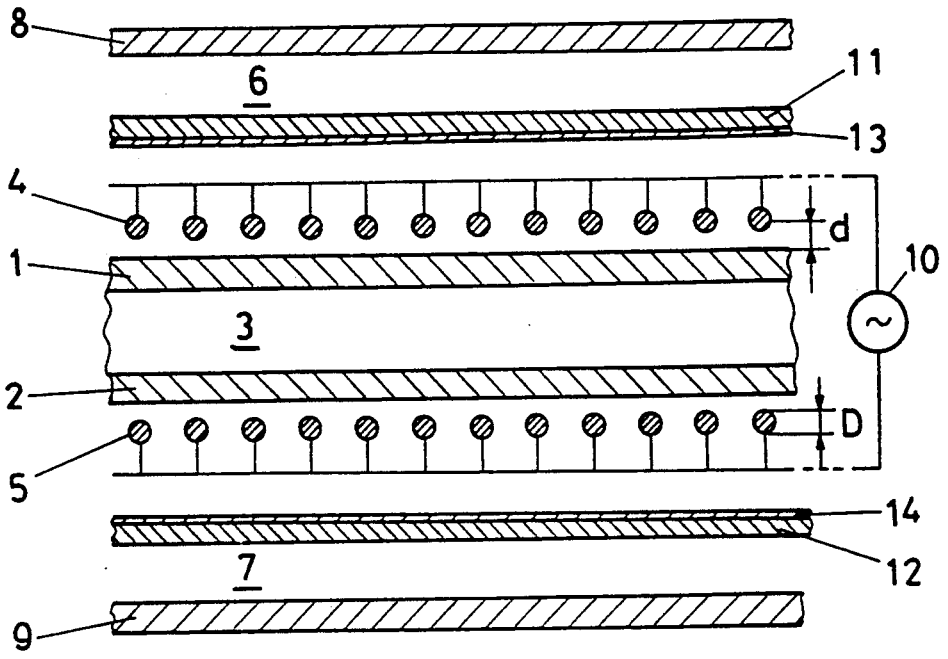
FIG. 1 shows in cross section a first illustrative embodiment of the invention in the form of an irradiation device having a flat radiator radiating to both sides.

Referring now to the drawings, wherein like reference numerals designate identical or corresponding parts throughout the several views, in FIG. 1 the irradiation device essentially comprises two spacedapart plates 1, 2 of dielectric material, for example quartz glass, which bound the discharge space 3. Positioned at a distance from the plates 1 and 2 are electrodes 4, 5, arranged in two treatment spaces 6, 7, which are bounded from the outside by walls 8 and 9. In the case of the example, the electrodes consist of a comparatively wide-meshed wire net, having a mesh width of around $10\times10$ mm$^2$.The average distance of the wires 4, 5 from the plates 1, 2 is to be greater than half the wire diameter D, typically less than 1 mm or a little more. These conditions are met for example by a wire net laid onto the dielectric 1 or 2 and clamped at the plate edges: due to the clamping at the edges, the wire net namely rests on the dielectric only locally. The inhomogeneities of the "outside discharges" brought about as a result are in this case negligible for the process.

The electrodes 3 and 4 are in each case connected parallel to each other — in the case of a wire net this condition is met automatically — and are each connected to the poles of an AC source 10 with adjustable frequency and amplitude of the output voltage. This AC source 10 corresponds in principle to those such as are used for the feeding of ozone generators. It typically delivers an adjustable AC voltage of the order of several kvolts, preferably $\geqq 10$ kvolts, at frequencies into the MHz range, depending on the electrode geometry, pressure in the discharge space and composition of the filling gas.

Arranged between the electrodes 4 and 5 and the housing walls 8 and 9, respectively, is the product to be treated, in the case of the example a substrate 11 and 12, respectively, in web form having a layer of varnish or paint 13 and 14, respectively, which layers contain UV-curing substances with photoinitiators.

The discharge space 3 between the plates 1 and 2 is filled with a filling gas emitting radiation under discharge conditions, for example mercury, rare gas, a rare gas/metal vapor mixture, a rare gas/halogen mixture, if appropriate with use of an additional, further rare gas, preferably Ar, He, Ne, Xe as buffer gas.

Depending on the desired spectral composition of the radiation, a substance/substance mixture according to the following table may be used here:

| Filling Gas | Radiation |
|---|---|
| Helium | 60–100 nm |
| Neon | 80–90 nm |
| Argon | 107–165 nm |

-continued

| Filling Gas | Radiation |
|---|---|
| Argon + fluorine | 180–200 nm |
| Argon + chlorine | 165–190 nm |
| Argon + crypton + chlorine | 165–190 nm, 200–240 nm |
| Xenon | 120–190 nm |
| Nitrogen | 337–415 nm |
| Crypton | 124 nm, 140–160 nm |
| Crypton + fluorine | 240–255 nm |
| Crypton + chlorine | 200–240 nm |
| Mercury | 185 nm, 254 nm, 295–315 nm 365 nm, 366 nm |
| Selenium | 196, 204, 206 nm |
| Deuterium | 150–250 nm |
| Xenon + fluorine | 340–360 nm, 400–550 nm |
| Xenon + chlorine | 300–320 nm |

In addition, a whole series of further filling gases come into consideration:

A rare gas (Ar, He, Kr, Ne, Xe) or Hg with a gas or vapor of $F_2$, $J_2$, $Br_2$, $Cl_2$ or a compound which eliminates one or more F, J, Br or Cl atoms in the discharge;

a rare gas (Ar, He, Kr, Nr, Xe) or Hg with $O_2$ or a compound which eliminates one or more O atoms in the discharge;

a rare gas (Ar, He, Kr, Ne, Xe) with Hg.

When a voltage is applied between the electrodes 4 and 5, a great number of discharges occur in the discharge space 3. The electron energy distribution in these discharges can be optimally adjusted by the thickness of the dielectric plates 1, 2 and their properties, the distance between the plates 1 and 2, the pressure and/or the temperature. The discharges radiate the UV light which then penetrates the transparent plates 1 and 2 into the immediately adjacent treatment spaces 6 and 7 and enters into interaction with the layers 13 and 14.

As well as these phenomena, however, there also occur in the treatment spaces 6 and 7 silent electrical discharges in the distances between the electrodes 4 and plate 1 and between electrodes 5 and plate 2. These "outside discharges" produce reaction products or ions, according to the ambient atmosphere — in air primarily ozone and nitrogen oxides — which, together with the UV radiation from the discharge space 3, decisively accelerate the curing of the layers 13 and 14, acting virtually as a catalyst.

By altering the discharge voltage and/or frequency and/or the distance between and/or distribution of the electrodes, either many by-products (strong outside discharges at high voltage) or with only negligibly few by-products, to none at all, can be generated.

Instead of a radiator radiating to both sides, such as that represented in FIG. 1, it is possible to produce an irradiation device with a UV radiator radiating only to one side, and consequently with only a single treatment space. This embodiment is represented diagrammatically by way of example in FIG. 2. Here, the discharge space is bounded on one side by the dielectric plate 1 and a plate-shaped electrode 5'. The operating principle of this device corresponds in all essential points to that shown in FIG. 1.

The invention is not of course restricted to flat radiators. Cylindrical irradiation devices, such as are illustrated by way of example in FIGS. 3 and 4, are also possible without departing from the scope of the invention.

In the case of the irradiation device with outside radiator, a metal tube 15, which forms the one electrode of the UV radiator, is concentrically surrounded by a tube 16 of dielectric material. The tube 16 is in turn surrounded by an electrode 17, which consists for example of a wire mesh bent in the form of a tube, leaving a clearance of a distance D. The outer termination is formed by an outer tube 18 positioned at a distance from the electrode 17. Such an irradiation device is suitable for example for treating UV-curing layers on the inside of hollow-cylindrical articles which are pushed into the treatment space 6.

Figure 3:
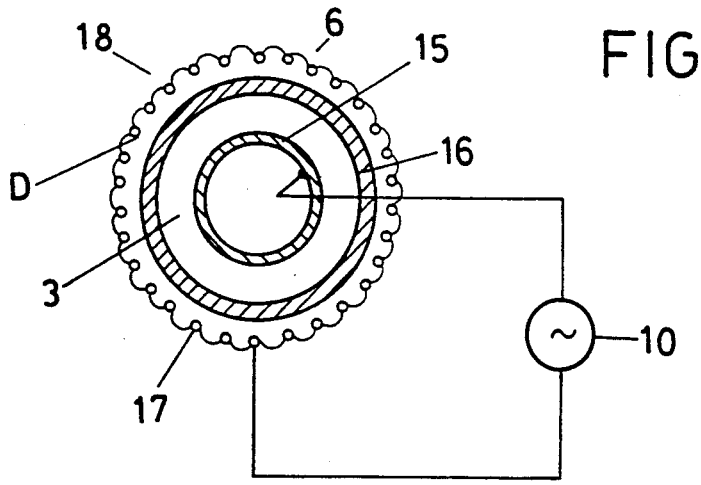
FIG. 3 shows in section an illustrative embodiment of a cylindrical irradiation device having an outer treatment space.
Figure 4:
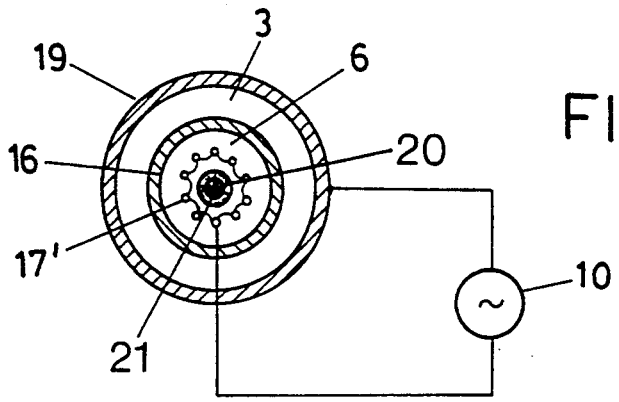
FIG. 4 shows in section an illustrative embodiment of a cylindrical irradiation device having an inner treatment space, which is suitable in particular for treating wire-like products.

The embodiment of the invention according to FIG. 4 is an irradiation device with an inside radiator. Arranged inside a metal tube 19, which forms the one electrode of the UV radiator, is a quartz tube 16. The space between the tubes 16 and 19 forms the discharge space 3. Arranged inside the quartz tube 16 — at a distance from it — is the other electrode 17', which can, in analogy with FIG. 3, consist of a tube-shaped wire mesh. In the case of the example, the product to be treated is a copper wire 21 provided with a UV-curing layer of varnish 20, as is used as conductor material for the windings of electrical machines and apparatus.

Figure 2:
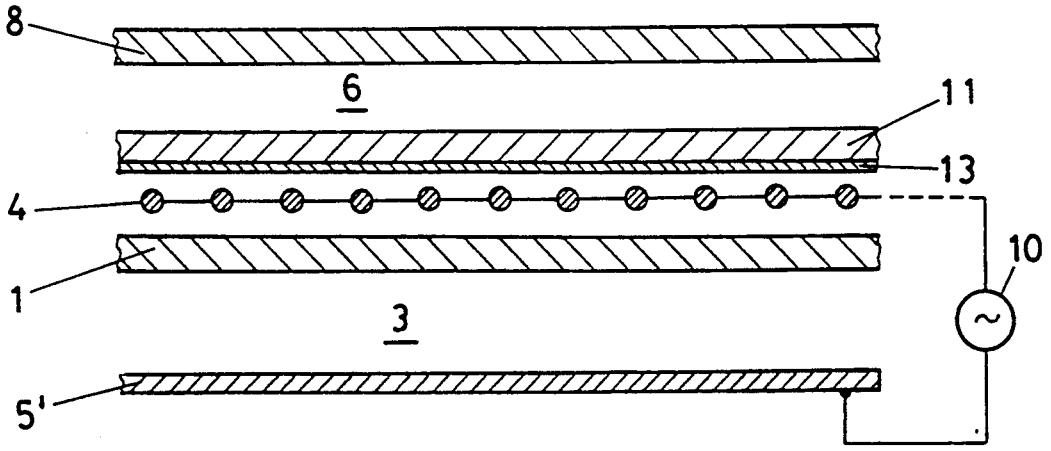
FIG. 2 shows a cross section through an irradiation device having a flat radiator radiating to one side.

The operating principle of the devices as shown in FIGS. 3 and 4 corresponds in all essential details to those shown in FIG. 1 and FIG. 2, respectively.

Figure 5:
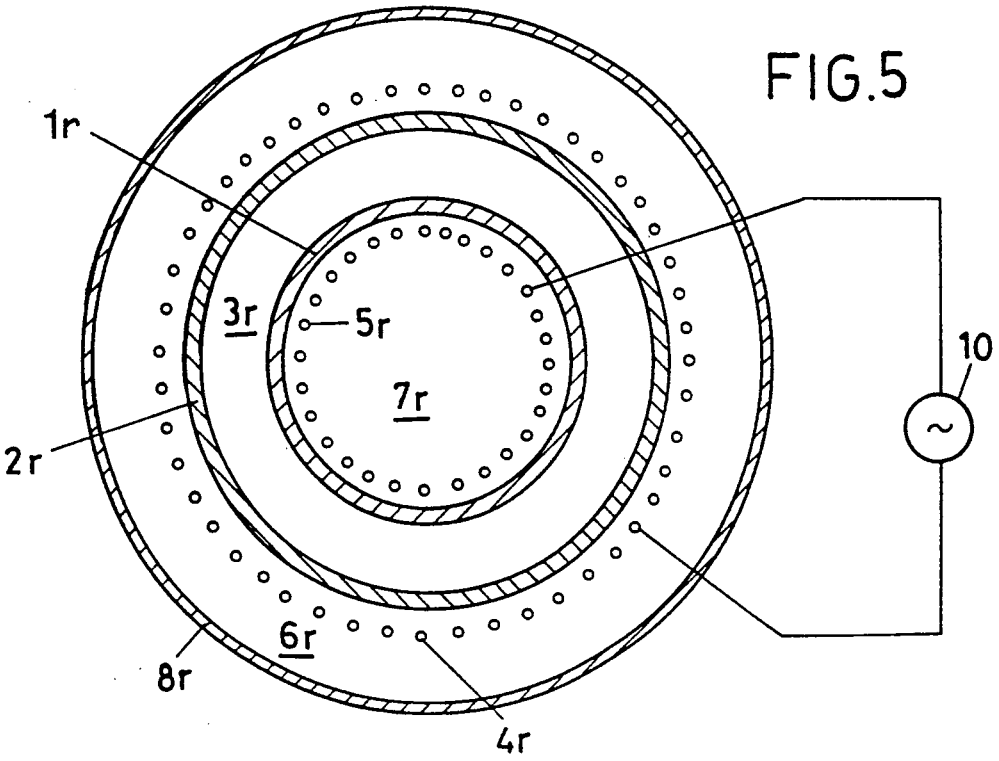
FIG. 5 shows a combination of the irradiation devices shown in FIGS. 3 and 4 having an inwardly and outwardly radiating UV radiator and inner and outer treatment spaces.

For the sake of completeness, it should be pointed out that cylindrical irradiation devices having an inwardly and outwardly radiating UV radiator are also possible. These correspond substantially to the type represented in FIG. 1, if one imagines the flat plates or electrodes there as being shaped into tubes. According to FIG. 5, the discharge space 3 is formed by two coaxial quartz tubes 1*r* and 2*r*. Electrodes 4*r* and 5*r* lie outside and inside the tubes 1*r* and 2*r*, respectively, and are positioned at a distance from them in analogy with FIG. 1. A tube 8*r* forms the outer termination. The annular space between the tubes 1*r* and 8*r* form the one (outer) treatment space 6, the inner space of the tube 2*r* forms the other (inner) treatment space 7*r*.

The irradiation devices described above are suitable for a great many applications: drying and/or curing of UV-curing varnishes and paints for protective and decorative purposes, adhesive layers on paper or plastic substrates, coatings of sheets or panels for the furnishing and packaging industry, polyester films, for example protective films for keyboards, UV casting compounds, UV clear varnishes and pigmented varnishes for data media, for example compact disks, UV varnishes for paper coatings.

Obviously, numerous modifications and variations of the present invention are possible in light of the above teachings. It is therefore to be understood that, within the scope of the appended claims, the invention may be practised otherwise than as specifically described herein.

What is claimed as new and desired to be secured by letters patent of the United States is:

1. An irradiation device for drying and/or curing paints, varnishes and similar coatings (13, 14; 20) having at least one UV high-power radiator, preferably an excimer radiator, having a discharge space (3) filled with filling gas, the filling gas emitting radiation, preferably excimer radiation, under the effect of silent electrical discharges, the discharge space being bounded by walls (1, 2), of which at least one wall consists of dielectric material and is transmissive to the radiation generated in the discharge space, having a pair of electrodes (4, 5) outside the discharge space (3), a treatment space (6, 7) immediately adjacent to one of the walls of the discharge space, and having an AC source (10), connected to the two electrodes (4, 5) for feeding the discharge, wherein at least the one electrode (4, 5) is positioned at a distance from the dielectric (1, 2; 16) immediately neighboring it in such a way that the coupling of the electrical energy from this one electrode into the discharge space (3) takes place essentially capacitively, so that, as well as the discharges in the actual discharge space (3), which are responsible for the generation of UV or VUV radiation, there also occur in the outside space (6, 7) electrical discharges which, along with the radiation produced in the discharge space (3), additionally act catalytically on said coatings (13, 14; 20).

2. The irradiation device as claimed in claim 1, wherein the discharge space is bounded by plates (1, 2) or tubes (1*r*, 2*r*; 15, 16; 16, 19), of which at least one plate or tube consists of dielectric material, and the filling gas is mercury, nitrogen, selenium, deuterium or a mixture of the substances alone or with a rare gas.

3. The irradiation device as claimed in claim 2, wherein the gas contains additions of sulfur, zinc, arsenic, selenium, cadmium, iodine or mercury.

4. The irradiation device as claimed in claim 1, wherein the discharge space is bounded by plates (1, 2) or tubes (1*r*, 2*r*; 15, 16; 16, 19), of which at least one plate or tube consists of dielectric material, and the filling gas emits excimer radiation under discharge conditions and is preferably a rare gas, a rare gas mixture or a rare gas/halogen mixture.

5. The irradiation device as claimed in one of claims 1 to 4, wherein at least two treatment spaces (6, 7) are provided, which immediately join the discharge space (3) lying in between them, the electrodes (4, 5; 4*r*, 5*r*) in each case lying at a distance from the walls of the discharge space (3) in the treatment spaces (6, 7; 6*r*, 7*r*).

6. The irradiation device as claimed in one of claims 1 to 4, wherein a discharge space (3) and treatment space (6) are provided, the discharge space being bounded by a first electrode (5'; 19) and a plate (1) or a tube (16) of dielectric material, wherein the other electrode (4; 17) is arranged in the treatment space (6) and at a distance from the plate or the tube of dielectric material.

7. The irradiation device as claimed in one of claims 1 to 4, wherein, seen from the discharge space (3; 3*r*), the product (11; 21) having the layers (13, 14; 20) to be treated is arranged in the treatment space (6, 7; 6*r*, 7*r*) behind the electrodes (4, 5; 4*r*, 5*r*; 17) transparent to the UV radiation and with the layer side facing the electrodes.

8. The irradiation device as claimed in one of claims 1 to 4, wherein the electrodes (4, 5; 4*r*, 5*r*; 17) consist of wire or wire mesh or wire fabric.

9. The irradiation device as claimed in claim 8, wherein the average distance (d) of the wires from the dielectric (1, 2) is greater than half the wire diameter (D).

* * * * *